US008456273B2

(12) United States Patent
Chen

(10) Patent No.: US 8,456,273 B2
(45) Date of Patent: Jun. 4, 2013

(54) CHIP RESISTOR DEVICE AND A METHOD FOR MAKING THE SAME

(75) Inventor: Full Chen, Kaohsiung (TW)

(73) Assignee: Ralec Electronic Corporation, Kaohsiung (TW)

( * ) Notice: Subject to any disclaimer, the term of this patent is extended or adjusted under 35 U.S.C. 154(b) by 20 days.

(21) Appl. No.: 13/226,094

(22) Filed: Sep. 6, 2011

(65) Prior Publication Data

US 2012/0235782 A1 Sep. 20, 2012

(51) Int. Cl.
*H01C 1/012* (2006.01)

(52) U.S. Cl.
USPC ..... 338/307; 338/309

(58) Field of Classification Search
USPC ..... 338/309, 307
See application file for complete search history.

(56) References Cited

U.S. PATENT DOCUMENTS 3,982,218 A * 9/1976 Adler et al. ..... 338/22 R
4,801,469 A * 1/1989 Norwood ..... 427/103

FOREIGN PATENT DOCUMENTS

TW M290606 U 5/2006

* cited by examiner

*Primary Examiner* — Kyung Lee
(74) *Attorney, Agent, or Firm* — Steven B. Phillips; Moore & Van Allen PLLC

(57) ABSTRACT

A chip resistor device includes: a dielectric substrate that has top and bottom surfaces and two opposite edge faces interconnecting the top and bottom surfaces; two electrodes that are formed on two opposite sides of the dielectric substrate and that cover the edge faces and parts of the top and bottom surfaces; a resistor layer that is formed on one of the top and bottom surfaces of the dielectric substrate between the electrodes and that is brought into contact with the electrodes; and a heat conductive layer that is disposed on the resistor layer oppositely of the dielectric substrate and between the electrodes, that contacts the resistor layer and the two electrodes, and that has a higher resistance than that of the resistor layer. A method for making the chip resistor device is also disclosed.

12 Claims, 8 Drawing Sheets

CHIP RESISTOR DEVICE AND A METHOD FOR MAKING THE SAME

BACKGROUND OF THE INVENTION

1. Field of the Invention

This invention relates to a resistor device, more particularly to a chip resistor device and a method for making the same.

2. Description of the Related Art

Referring to FIG. 1, a conventional chip resistor device 1 is suitable for use as a microresistor on a printed circuit board, and includes a dielectric substrate 11, a resistor layer 13 formed on the dielectric substrate 11, and two electrodes 12 respectively fitted to two opposite sides of the dielectric substrate 11 and the resistor layer 13. In order to obtain a predetermined resistance value of the chip resistor device, such as a SMD (surface mounted device) chip resistor disclosed in Taiwan Utility no. M290606, the resistor layer 13 is laser-trimmed to form a plurality of laser-trimmed gaps 14 that expose the dielectric substrate 11 (see FIGS. 2 and 3). After laser-trimming, the current path in the chip resistor device 1 is increased, and thus, the resistance of the chip resistor device 1 increases.

In the aforesaid chip resistor device, heat produced by the resistor layer 13 should be adequately dissipated. Otherwise, the chip resistor device 1 is likely to overheat, which results in an inferior power per unit area in the chip resistor device 1, a shift in the thermal conductivity of the resistor layer 13 which causes unstable resistance for the resistor layer 13, and a shorter service life of the chip resistor device 1.

SUMMARY OF THE INVENTION

Therefore, an object of the present invention is to provide a chip resistor device and a method for making the same that can overcome the aforesaid drawbacks associated with the prior art.

According to a first aspect of this invention, a chip resistor device comprises:

a dielectric substrate that has top and bottom surfaces and two opposite edge faces interconnecting the top and bottom surfaces;

two electrodes that are formed on two opposite sides of the dielectric substrate and that cover the edge faces and parts of the top and bottom surfaces;

a resistor layer that is formed on one of the top and bottom surfaces of the dielectric substrate between the electrodes and that is brought into contact with the electrodes; and a heat conductive layer that is disposed on the resistor layer oppositely of the dielectric substrate and between the electrodes, that contacts the resistor layer and the two electrodes, and that has a higher resistance than that of the resistor layer.

According to a second aspect of this invention, a method for making a chip resistor device comprises:

(a) providing a dielectric substrate that has top and bottom surfaces and two opposite edge faces interconnecting the top and bottom surfaces;

(b) forming two electrodes on two opposite sides of the dielectric substrate to cover the edge faces and parts of the top and bottom surfaces;

(c) forming a resistor layer on the top and bottom surfaces of the dielectric substrate between the electrodes such that two opposite ends of the resistor layer abut respectively against the electrodes; and (d) forming a heat conductive layer and an insulative spacer on the resistor layer, the heat conductive layer having a resistance higher than that of the resistor layer and being divided into two parts by the insulative spacer, one of the two parts being disposed between one of the electrodes and the insulative spacer and the other one of the two parts being disposed between the other one of the electrodes and the insulative spacer.

According to a third aspect of this invention, a method for making a chip resistor device comprises:

(a) providing a dielectric substrate that has top and bottom surfaces and two opposite edge faces interconnecting the top and bottom surfaces;

(b) forming a resistor layer on one of the top and bottom surfaces of the dielectric substrate; and (c) forming a heat conductive layer and an insulative spacer on the resistor layer, the heat conductive layer having a resistance higher than that of the resistor layer and being divided into two parts by the insulative spacer, the two parts extending oppositely from the insulative spacer toward the opposite edge faces of the dielectric substrate to cover the resistor layer, the edge faces and parts of the top and bottom surfaces.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
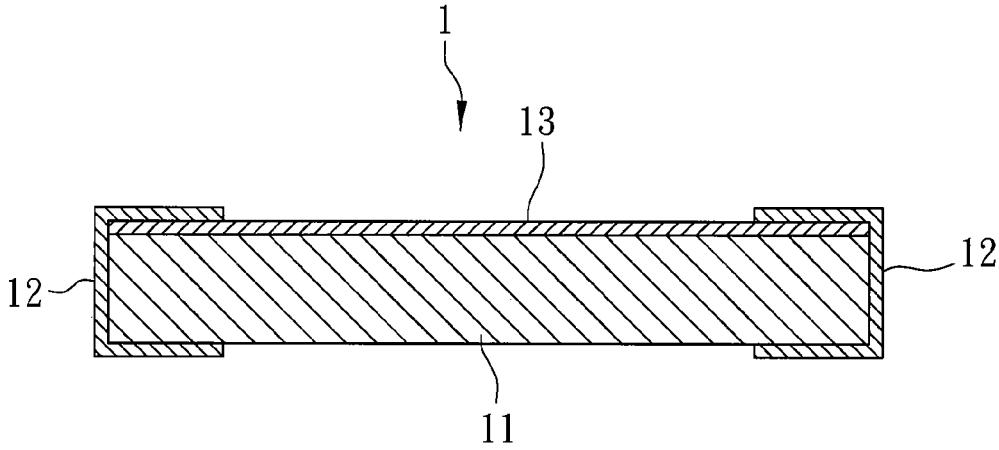
FIG. 1 PRIOR ART
FIG. 1 is a cross-sectional view of a conventional chip resistor device.
Figure 2:
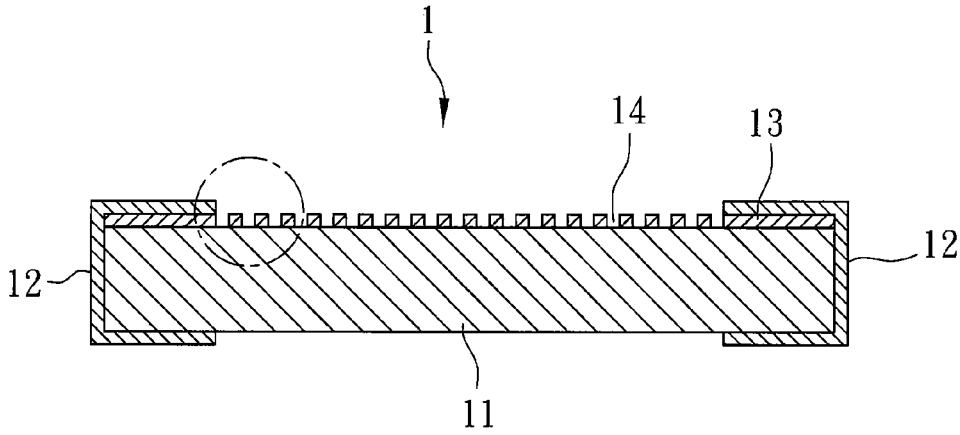
FIG. 2 PRIOR ART
FIG. 2 is a cross-sectional view illustrating a chip resistor device disclosed in Taiwan Utility no. M290606.
Figure 3:
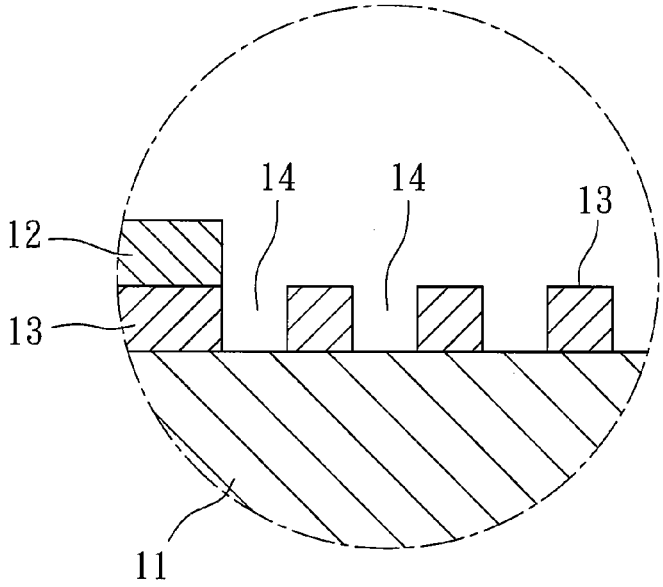
FIG. 3 PRIOR ART
FIG. 3 is an enlarged view of an encircled region shown in FIG. 2.

Before the present invention is described in greater detail with reference to the accompanying preferred embodiments, it should be noted herein that like elements are denoted by the same reference numerals throughout the disclosure.

Figure 4:
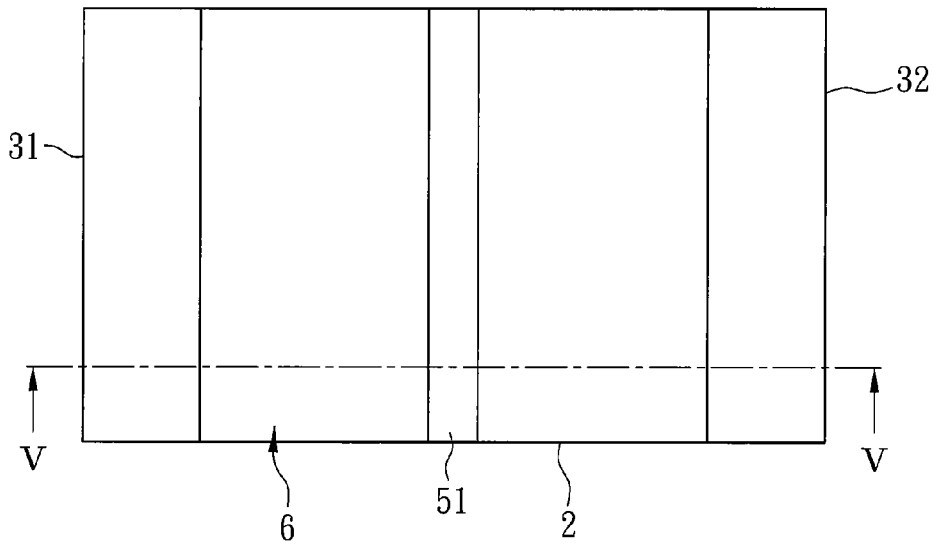
FIG. 4 is a top view of the first preferred embodiment of a chip resistor device according to this invention.
Figure 5:
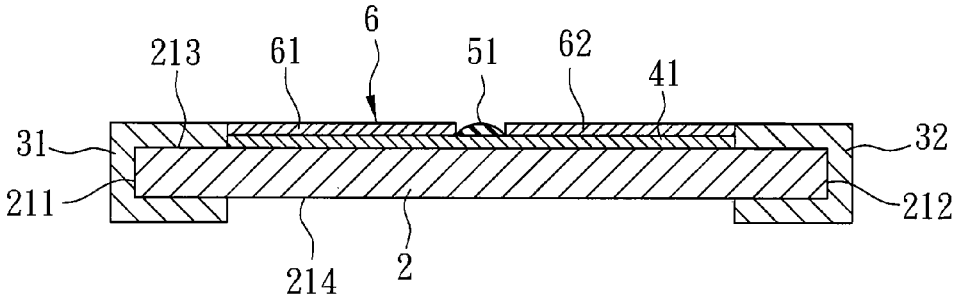
FIG. 5 is a cross-sectional view taken along line V-V in FIG. 4.

FIGS. 4 and 5 show the first preferred embodiment of a chip resistor device according to the present invention. The chip resistor device comprises a dielectric substrate 2, two electrodes 31, 32, a resistor layer 41, an insulative spacer 51, and a heat conductive layer 6.

The dielectric substrate 2 has top and bottom surfaces 213, 214 and two opposite edge faces 211, 212 that interconnect the top and bottom surfaces 213, 214. The two electrodes 31, 32 are formed on two opposite sides of the dielectric substrate 2, and cover the edge faces 211, 212 and parts of the top and bottom surfaces 213, 214. The resistor layer 41 is formed on the top surface 213 of the dielectric substrate 2 between the two electrodes 31, 32, and is brought into contact with the electrodes 31, 32. The heat conductive layer 6 is disposed on the resistor layer 41 oppositely of the dielectric substrate 2 and between the electrodes 31, 32, contacts the resistor layer 41 and the two electrodes 31, 32, and has a higher resistance than that of the resistor layer 41. The insulative spacer 51 is disposed on the resistor layer 41 to divide the heat conductive layer 6 into two parts 61, 62. The part 61 is disposed between the electrode 31 and the insulative spacer 51, and the part 62 is disposed between the electrode 32 and the insulative spacer 51. In the chip resistor device of this invention, the resistances in the presence and absence of the insulative spacer 51 are different.

Because the heat conductive layer 6 contacts the electrodes 31, 32, the heat generated by the chip resistor device can be transferred to the electrodes 31, 32 through the heat conductive layer 6, and can be further dissipated to other heat dissipating elements or the external environment, thereby reducing the temperature of the chip resistor device.

Alternatively, the heat conductive layer 6 may be formed unevenly.

Figure 6:
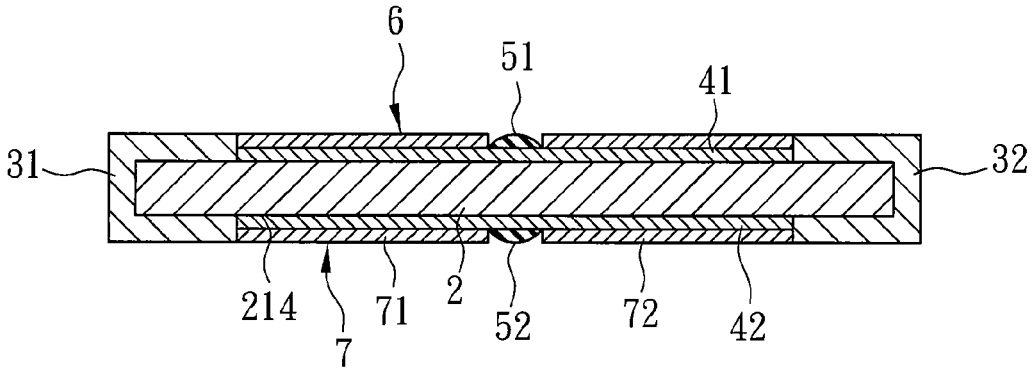
FIG. 6 is a cross-sectional view illustrating the second preferred embodiment of a chip resistor device according to this invention.

FIG. 6 shows the second preferred embodiment of a chip resistor device of this invention. The chip resistor device comprises a dielectric substrate 2, two electrodes 31, 32, a first resistor layer 41, a first insulative spacer 51, a first heat conductive layer 6, a second resistor layer 42, a second insulative spacer 52, and a second heat conductive layer 7.

The arrangements of the dielectric substrate 2, the two electrodes 31, 32, the first resistor layer 41, the first insulative spacer 51, and the first heat conductive layer 6 in this embodiment are the same as those of the first preferred embodiment.

The second resistor layer 42 is formed on the bottom surface 214 of the dielectric substrate 2 between the two electrodes 31, 32, and is brought into contact with the electrodes 31, 32. The second heat conductive layer 7 is disposed on the second resistor layer 42 oppositely of the dielectric substrate 2 and between the electrodes 31, 32, contacts the second resistor layer 42 and the two electrodes 31, 32, and has a higher resistance than that of the second resistor layer 42. The second insulative spacer 52 is disposed to divide the second heat conductive layer 7 into two parts 71, 72. The part 71 is disposed between the electrode 31 and the second insulative spacer 52. The part 72 is disposed between the electrode 32 and the second insulative spacer 52.

Figure 7:
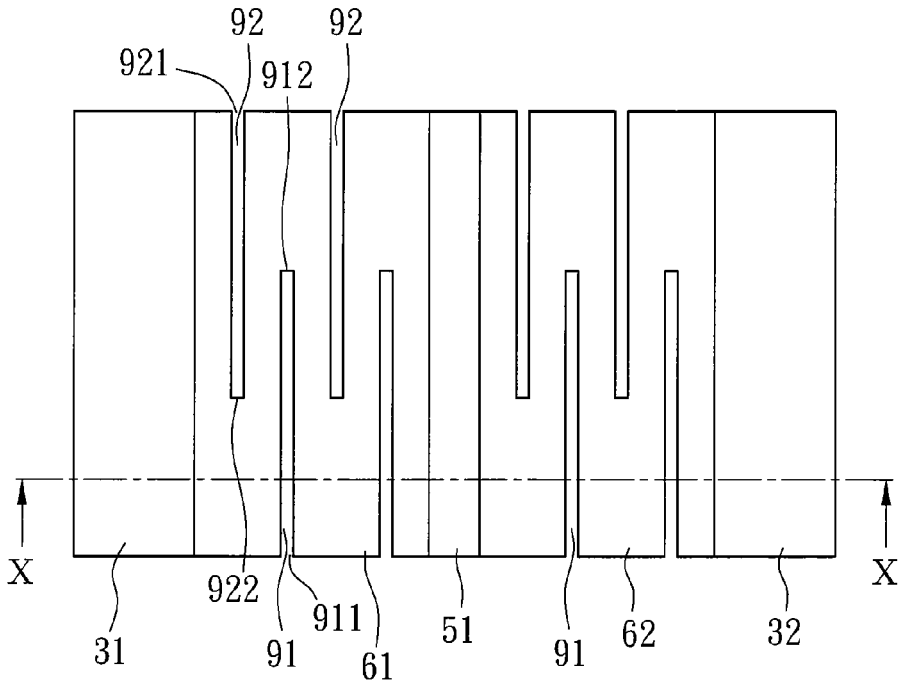
FIG. 7 is a top view of the third preferred embodiment of a chip resistor device of this invention.
Figure 8:
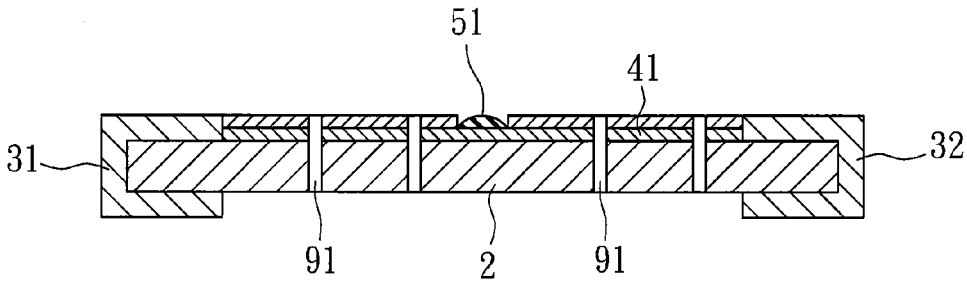
FIG. 8 is a cross-sectional view taken along line X-X in FIG. 7.

Referring to FIGS. 7 and 8, the third preferred embodiment of a chip resistor device according to this invention differs from the first preferred embodiment in that the third preferred embodiment further comprises a plurality of slits 91, 92. To be specific, in this embodiment, the resistor layer 41 has opposite first and second edges (not shown) that extend from one of the electrodes 31, 32 to the other one of the electrodes 31, 32, and the chip resistor device includes a plurality of the first and second slits 91, 92 that are disposed alternately at intervals and that extend transversely of the first and second edges of the resistor layer 41. Each of the first slits 91 has one end 911 extending through the first edge and another end 912 spaced apart from the second edge. Each of the second slits 92 has one end 921 extending through the second edge and another end 922 spaced apart from the first edge. Therefore, the resistor layer 41 is formed with a continuous electrical path that turns near the first and second edges alternately. In this embodiment, the first and second slits 91, 92 penetrate through not only the resistor layer 41 but also the dielectric substrate 2 and the heat conductive layer 6. However, it should be noted that, the first and second slits 91, 92 can be merely formed in the resistor layer 41, i.e., the first and second slits 91, 92 do not penetrate through the dielectric substrate 2 and the heat conductive layer 6.

Figure 9:
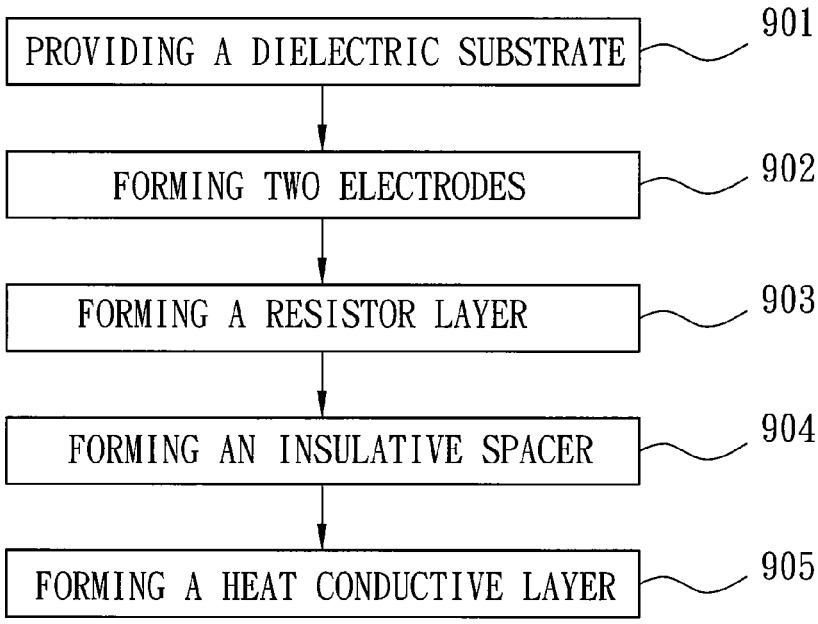
FIG. 9 is a flow chart illustrating the first preferred embodiment of a method for making the chip resistor device shown in FIG. 5.

Referring to FIG. 9, the first preferred embodiment of a method for making the chip resistor device shown in FIG. 5 comprises the following steps.

In step 901, the dielectric substrate 2 is provided.

In step 902, the two electrodes 31, 32 are formed on the two opposite sides of the dielectric substrate 2 to cover the edge faces 211, 212 and the parts of the top and bottom surfaces 213, 214.

In step 903, the resistor layer 41 is formed on the top surface 213 of the dielectric substrate 2 between the electrodes 31, 32 such that two opposite ends of the resistor layer 41 abut respectively against the electrodes 31, 32. In this step, the resistor layer 41 is formed by spray coating a conductive paint or a high-resistance material.

In step 904, the insulative spacer 51 is formed on the resistor layer 41 between the electrodes 31, 32. The insulative spacer 51 is formed using a screen coating machine. Alternatively, the insulative spacer 51 can be formed using a pattern-transferring machine, or a paste dispenser.

In step 905, the heat conductive layer 6 is formed on the resistor layer 41. The heat conductive layer 6 has a resistance higher than that of the resistor layer 41 and is divided into the two parts 61, 62 by the insulative spacer 51. In this embodiment, the heat conductive layer 6 contains copper and is formed by electroforming. Alternatively, the heat conductive layer 6 may contain a metal selected from gold, silver, iron, tin, aluminum or combinations thereof.

Preferably, the method of this invention can further comprise, between steps 904 and 905, a step of forming the insulating layer (not shown) on the bottom surface 214 of the dielectric substrate 2 between the electrodes 31, 32. The insulating layer 8 may be formed by coating an insulating material or attaching an insulating element such as an insulating adhesive tape on the bottom surface 214 of the dielectric substrate 2 between the electrodes 31, 32. Accordingly, the electrodes 31, 32 are insulated by the insulating layer so as to prevent formation of a lower circuit path along the bottom surface 214 of the dielectric substrate 2 upon and after step 905.

Figure 10:
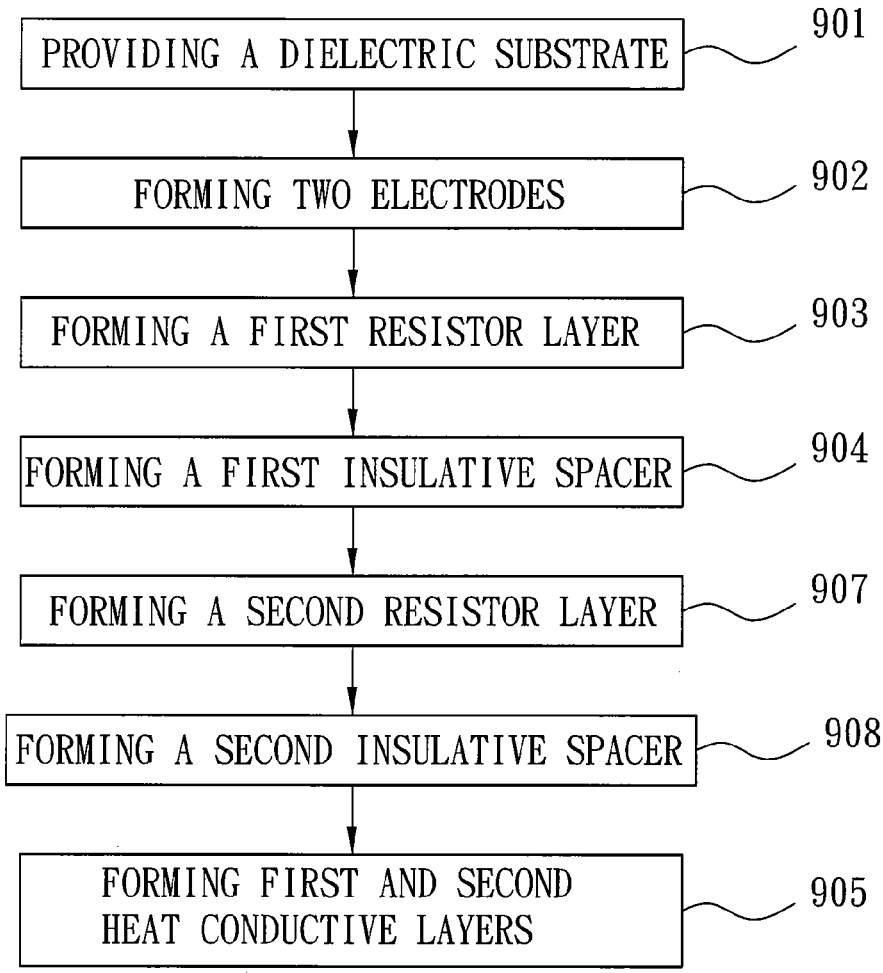
FIG. 10 is a flow chart illustrating the second preferred embodiment of a method for making the chip resistor device shown in FIG. 6.

Referring to FIG. 10, the second preferred embodiment of a method for making the chip resistor device shown in FIG. 6 is similar to that of the first preferred embodiment, except that the second preferred embodiment further comprises the steps of forming the second resistor layer 42, the second insulative spacer 52, and the second heat conductive layer 7.

After step 904, the second resistor layer 42 is formed on the bottom surface 214 of the dielectric substrate 2 between the electrodes 31, 32 such that two opposite ends of the second resistor layer 42 abut respectively against the electrodes 31, 32 (step 907). In this embodiment, the second resistor layer 42 is formed by spray coating a conductive paint.

After step 907, the second insulative spacer 52 is formed on the second resistor layer 42 between the electrodes 31, 32 (step 908). The second insulative spacer 52 is formed using a screen coating machine. Alternatively, the second insulative spacer 52 can be formed using a pattern-transferring machine, or a paste dispenser.

After step 908, the first heat conductive layer 6 and the second heat conductive layer 7 are simultaneously formed by electroforming (step 905). In this embodiment, the second heat conductive layer 7 contains copper. Alternatively, the second heat conductive layer 7 may contain a metal selected from gold, silver, iron, tin, aluminum or combinations thereof.

Figure 11:
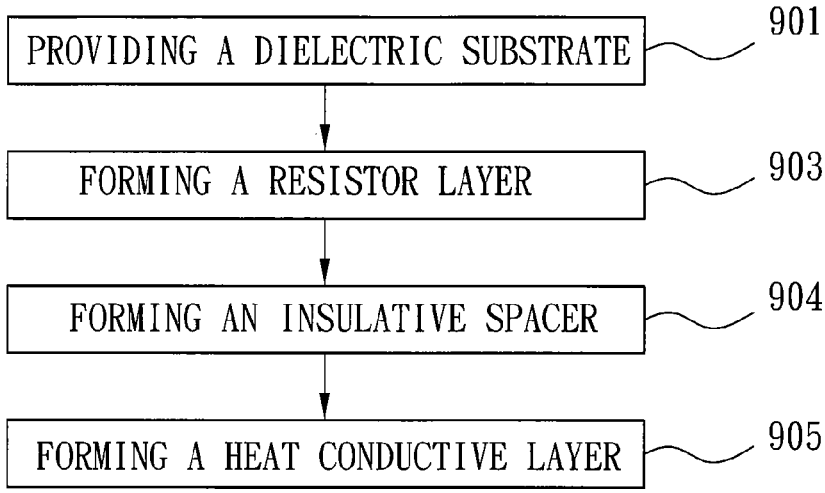
FIG. 11 is a flow chart illustrating the third preferred embodiment of a method for making a chip resistor device of this invention.
Figure 12:
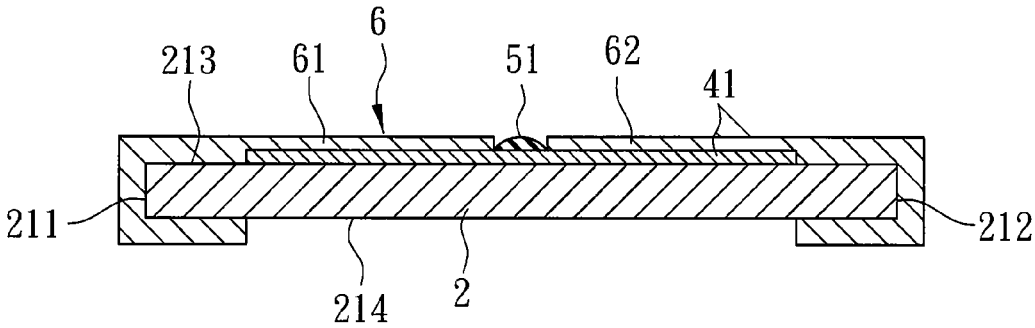
FIG. 12 is a cross-sectional view of the chip resistor device that is made according to the method shown in FIG. 11.

Referring to FIGS. 11 and 12, the third preferred embodiment of a method for making a chip resistor device shown in FIG. 12 is similar to that of the first preferred embodiment, except that the step 902 for forming the two electrodes 31, 32 is omitted. Therefore, in step 903, the resistor layer 41 is formed on a portion of the top surface 213 of the dielectric substrate 2. In step 905, the heat conductive layer 6 is formed on the resistor layer 41 and the dielectric substrate 2, and is divided into two parts 61, 62 by the insulative spacer 51. The two parts 61, 62 extend oppositely from the first insulative spacer 51 toward the opposite edge faces 211, 212 of the dielectric substrate 2 to cover the resistor layer 41, parts of the top surface 213 that are not covered by the resistor layer 41, the edge faces 211, 212, and parts of the bottom surface 214. It should be noted that the two parts 61, 62 of the heat conductive layer 6 do not contact each other at the bottom surface 214. In this embodiment, the heat conductive layer 6 exhibits heat conductive property and electrode functionality.

In summary, by forming the conductive layers 6, 7 on the resistor layers 41, 42 in this invention, the heat generated from the chip resistor device may be efficiently dissipated.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A chip resistor device, comprising:

a dielectric substrate that has top and bottom surfaces and two opposite edge faces interconnecting said top and bottom surfaces;

two electrodes that are formed on two opposite sides of said dielectric substrate and that cover said edge faces and parts of said top and bottom surfaces;

a first resistor layer that is formed on one of said top and bottom surfaces of said dielectric substrate between said electrodes and that is brought into contact with said electrodes;

a first heat conductive layer that is disposed on said first resistor layer oppositely of said dielectric substrate and between said electrodes, that contacts said first resistor layer and said two electrodes, and that has a higher resistance than that of said first resistor layer; and a first insulative spacer dividing said first heat conductive layer into two parts, one of which is disposed between one of said electrodes and said first insulative spacer and the other one of which is disposed between the other one of said electrodes and said first insulative spacer.

2. The chip resistor device of claim 1, further comprising a second resistor layer that is formed on the other one of said top and bottom surfaces of said dielectric substrate between said electrodes and that is brought into contact with said electrodes, and a second heat conductive layer that is disposed on said second resistor layer oppositely of said dielectric substrate and between said electrodes, that contacts said second resistor layer and said two electrodes, and that has a higher resistance than that of said second resistor layer.

3. The chip resistor device of claim 2, further comprising a second insulative spacer dividing said second heat conductive layer into two parts, one of which is disposed between one of said electrodes and said second insulative spacer and the other one of which is disposed between the other one of said electrodes and said second insulative spacer.

4. The chip resistor device of claim 2, wherein each of said first and second heat conductive layers contains a metal selected from the group consisting of gold, silver, copper, iron, tin, aluminum and combinations thereof.

5. A method for making a chip resistor device, comprising:

(a) providing a dielectric substrate that has top and bottom surfaces and two opposite edge faces interconnecting the top and bottom surfaces;

(b) forming two electrodes on two opposite sides of the dielectric substrate to cover the edge faces and parts of the top and bottom surfaces;

(c) forming a first resistor layer on one of the top and bottom surfaces of the dielectric substrate between the electrodes such that two opposite ends of the first resistor layer abut respectively against the electrodes; and (d) forming a first heat conductive layer and a first insulative spacer on the first resistor layer, the first heat conductive layer having a resistance higher than that of the first resistor layer and being divided into two parts by the first insulative spacer, one of the two parts being disposed between one of the electrodes and the first insulative spacer and the other one of the two parts being disposed between the other one of the electrodes and the first insulative spacer.

6. The method of claim 5, further comprising:

(e) forming a second resistor layer on the other one of the top and bottom surfaces of the dielectric substrate between the electrodes such that two opposite ends of the second resistor layer abut respectively against the electrodes; and (f) forming a second heat conductive layer and a second insulative spacer on the second resistor layer, the second heat conductive layer having a resistance higher than that of the second resistor layer and being divided into two parts by the second insulative spacer, one of the two parts being disposed between one of the electrodes and the second insulative spacer and the other one of the two parts being disposed between the other one of the electrodes and the second insulative spacer.

7. The method of claim 6, wherein steps (d) and (f) are conducted at the same time.

8. The method of claim 6, wherein in steps (d) and (f), each of the first and second heat conductive layers contains copper and is formed by electroforming.

9. The method of claim 6, wherein in steps (c) and (e), each of the first and second resistor layers is conductive paint and is formed by coating.

10. A method for making a chip resistor device, comprising:

(a) providing a dielectric substrate that has top and bottom surfaces and two opposite edge faces interconnecting the top and bottom surfaces;

(b) forming a resistor layer on one of the top and bottom surfaces of the dielectric substrate; and (c) forming a heat conductive layer and an insulative spacer on the resistor layer, the heat conductive layer having a resistance higher than that of the resistor layer and being divided into two parts by the insulative spacer, the two parts extending oppositely from the insulative spacer toward the opposite edge faces of the dielectric substrate to cover the resistor layer, and the edge faces and parts of the top and bottom surfaces of the dielectric substrate.

11. The method of claim 10, wherein in step (b), the resistor layer is conductive paint and is formed by coating.

12. The method of claim 10, wherein in step (c), the heat conductive layer contains copper and is formed by electroforming.

* * * * *